United States Patent [19]

Parkes

[11] 4,003,677

[45] Jan. 18, 1977

[54] FAN ASSEMBLY WITH BLADES SECURED BETWEEN TWO HUB MEMBERS

[75] Inventor: George Robertson Parkes, Streetly, England

[73] Assignee: Wilmot Breeden (Truflo) Limited, England

[22] Filed: May 2, 1974

[21] Appl. No.: 466,454

[30] Foreign Application Priority Data

May 7, 1973 United Kingdom ..... 21679/73

[52] U.S. Cl. ..... 416/208; 416/214 R; 416/241 A

[51] Int. Cl.[2] ..... F04D 29/34

[58] Field of Search ..... 416/206–208, 416/214, 215, 222, 241 A

[56] References Cited

UNITED STATES PATENTS

| | | | |
|---|---|---|---|
| 735,905 | 8/1903 | Pinkert | 416/208 |
| 2,382,535 | 8/1945 | Bauer | 416/208 |
| 3,056,581 | 10/1962 | Castle et al. | 416/222 |
| 3,161,239 | 12/1964 | Andersen | 416/214 |
| 3,388,749 | 6/1968 | Woods et al. | 416/241 A X |
| 3,545,885 | 12/1970 | Killam | 416/208 X |
| 3,687,569 | 8/1972 | Klompas | 416/207 X |
| 3,698,837 | 10/1972 | Marcellin | 416/208 |
| 3,801,221 | 4/1974 | Zlotek | 416/241 A |

FOREIGN PATENTS OR APPLICATIONS

| | | | |
|---|---|---|---|
| 1,435,444 | 3/1966 | France | 416/208 |
| 303,379 | 12/1919 | Germany | 416/214 |
| 1,428,111 | 11/1968 | Germany | 416/222 |
| 1,428,116 | 11/1968 | Germany | 416/241 A |
| 1,062,881 | 8/1959 | Germany | 416/208 |
| 492,801 | 9/1938 | United Kingdom | 416/244 |
| 575,578 | 2/1946 | United Kingdom | 416/241 A |
| 853,331 | 11/1960 | United Kingdom | 416/241 A |
| 52 | 1/1907 | United Kingdom | 416/208 |
| 638,856 | 6/1950 | United Kingdom | 416/208 |
| 860,281 | 2/1961 | United Kingdom | 416/214 |
| 543,557 | 3/1942 | United Kingdom | 416/214 |

*Primary Examiner*—Everette A. Powell, Jr.
*Attorney, Agent, or Firm*—Watson, Cole, Grindle & Watson

[57] ABSTRACT

A fan comprises a flat disc sandwiched between two hub members, together with two or more blades, ech blade having a boss with a slit so that the boss straddles the peripheral portion of the disc and is gripped by the hub members. Fans can readily be assembled with any required number of blades and the blades can be set at any required angle by cutting the slits at the appropriate angle.

4 Claims, 3 Drawing Figures

FAN ASSEMBLY WITH BLADES SECURED BETWEEN TWO HUB MEMBERS

BACKGROUND OF THE INVENTION

1. Field of the invention.

This invention relates to fans having blades assembled on a hub member.

2. Prior Art.

It is known, e.g. in British Patent Specification No. 860281, German No. 1059290 and Netherlands No. 67/01215, to construct a fan by securing together two hub plates which are shaped to grip the roots of each blade.

SUMMARY OF THE INVENTION

This invention is directed to an improved construction facilitating the assembly of a fan with any desired number of blades and permitting the blades to be assembled at any required angle.

According to one aspect of this invention, a fan comprises a flat plate member sandwiched between two hub members and two or more blades, each blade having a boss at the root end of the blade with a groove in the boss so that the boss can partially straddle the periphery of said plate member, and means securing the two hub members and plate together with the hub members at least partially embracing said bosses whereby the blades are held onto said plate.

By making each boss of circular cross-section in all planes transverse to the axis of the boss, smoothly curved in its longitudinal section, having its maximum diameter intermediate its ends, and having the side surface of the boss merge smoothly into an end surface nearer the blade, which end surface is a portion of a spherical surface whose radius of curvature is equal to the distance of that surface from the center point of said flat plate member, it becomes possible to have hub members of uniform cross-section in all radial planes so that the hub members fit closely around the side surfaces and embrace the spherical end surface of the boss.

The plate is conveniently a flat disc. The blades conveniently each have a boss which is circular in section in any plane normal to a radial line from the axis of the fan through the centre of the boss. A groove may be formed, e.g., cut, in such a boss at any angle as required so that the blade can be set on the disc at the appropriate angle of incidence. Each groove is conveniently arranged to extend diametrically across the boss. With a disc, any number of blades may be set around the periphery of the disc, limited only by the space required to accommodate them. When the blades have been assembled on the disc, the hub members are put in position and secured to the disc, for example by spot welding or riveting. It will be seen that this construction permits of the use of standardised blade plates and hub members, yet fans can readily be assembled with any required number of blades and with the blades set at any desired angle. It will, moreover, be appreciated that by the use of different sizes of blades, it is possible to use a common set of hub members and plates for assembling fans of different external diameters.

As previously mentioned, the aforementioned plate is conveniently a flat disc; this enables the blades to be set at any point around the disc. However, if the blades are to be set only at predetermined points, it would be possible to use suitably shaped plates which were not necessarily circular.

Preferably, the peripheral portions of the hub members are shaped so as closely to embrace the boss of the blades.

Using circular bosses, as described above, a groove may be cut in the boss at any angle according to the desired angular setting of the blade with respect to the fan axis whilst still permitting the hub members to fit closely around and hold the blade in position. It will however be apparent that, if the blades are to be set only at predetermined angles, then non-circular bosses could be employed.

The hub members merely have to ensure that the blade is held in position on the plate. The blades are conveniently formed of a resilient plastic material so that a narrow groove can be used which will grip the plate firmly. The plate and hub members typically are formed of metal, e.g., mild steel. The peripheries of the hub members may be shaped to extend around the sides and part of the upper surface of the boss.

The boss may have a central recess for lightness, the aforementioned groove in this case being formed in the periphery of the boss.

The invention furthermore includes within its scope a method of manufacturing a fan comprising the steps of forming a groove in the boss of each blade of the fan, assembling the blade on a plate by putting the grooves over the periphery of the plate so that the blades are spaced around the periphery of the plate and then securing two hub members to the plate, the hub members being shaped to grip the bosses of the blades.

DESCRIPTION OF THE PREFERRED EMBODIMENT

Figure 1:
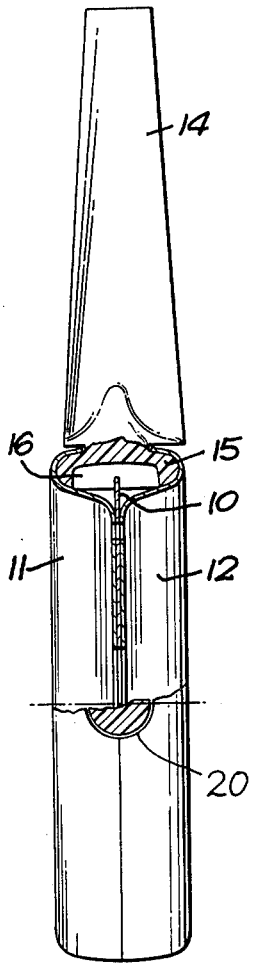
FIG. 1 is a view in side elevation, partly in section, of a fan with one blade in position.
Figure 2:
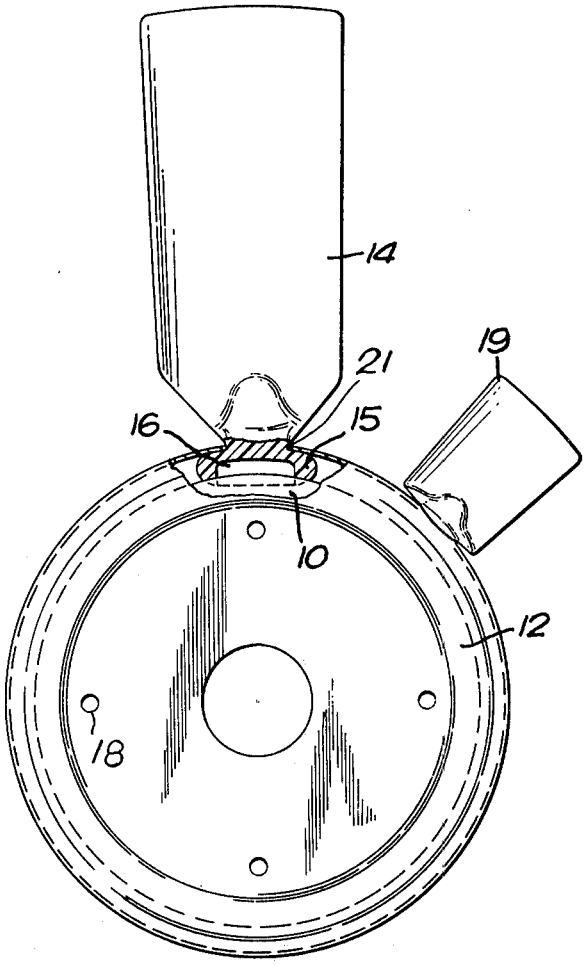
FIG. 2 is a front elevation of the fan blade assembly of FIG. 1, showing, for illustrative purposes, two different sizes of fan blades.
Figure 3:
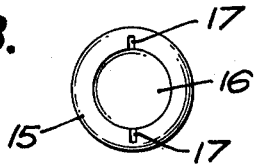
FIG. 3 is an underside plan view of the boss of a blade.

Referring to the drawings, the fan assembly comprises a circular mild steel disc 10 which is sandwiched between two mild steel hub members 11, 12. These hub members lie flat against the disc 10 over at least part of the area thereof. In this particular embodiment, there is a central bore for securing the assembly on a drive member, and the members 11, 12 lie against the surfaces of disc 10 in an annular region around this bore. At the periphery of the hub members, they extend outwardly away from the disc 10 and are shaped so as partially to enclose an annular region. The fan has two or more blades 14 each with a boss 15 which is circular in section (the section being in any plane normal to a radial line from the axis of the fan through the centre of the boss). The boss portion, considered in section in the radial plane through the axis of the hub, however, is curved to fit the curved shape of the hub members so that these partially embrace the boss, as is clearly seen in FIG. 1. As shown in FIGS. 1, 2 and 3, the boss 15 has a hollowed-out circular portion 16. A groove 17 (FIG. 3) is formed diametrically across the base of the boss but extending not quite to the periphery of the boss. Because of the hollowed-out circular portion 15, this groove 17 is constituted by two portions near the periphery of the boss. The fan blade is formed of a resilient plastics material and the side walls of the groove 17 fit closely over and resiliently grip the disc 10.

In assembling the fan, the blades 14 are firstly formed with grooves at the required angles. This may be done, for example, by machining grooves into previously moulded fan blades. The fan blades 14 are then assembled on the disc 10. The hub members 11, 12 are put in position so that their peripheral portions partially enclose the bosses 15 of all the blades and then the hub plates 11, 12 and disc 10 are assembled together, for example by riveting or spot welding as indicated at 18 on FIG. 2. This secures the fan blades in position. The hub members 11, 12 thus form clamping plates. The angle of the fan blades is set by the engagement of the disc 10 with the grooves. Thus there is no possibility of the angular setting of the blades changing in use. As is clearly seen in the lower part of FIG. 1, the outer peripheries of the hub members are adjacent one another in the regions between the blades. The hub members 11, 12 firmly hold the boss thereby ensuring that the fan blades cannot be removed from the remainder of the assembly.

It will be noted that any number of blades can be fitted to a hub, limited only by spatial considerations in putting the blades around the hub. The blades can be set at any required angle by appropriately machining the groove in the boss. It is possible to assemble a fan with blades of any size as is shown, for example, in FIG. 2 where, in addition to the blade 14, there is shown a smaller blade 19. It will be understood that normally a fan will be assembled with a plurality of blades of one size only. Once the fan has been assembled by spot welding or riveting the hub members and disc in position, the unit is tamperproof in that the blades cannot be removed or changed in position without breaking a part of the welded or riveted assembly.

Once a number of blades has been selected for a fan design, the abutting hub members 11 and 12 are notched by conventional means as at 20 to embrace the stem 21 of the blade which interconnects the blade portion 14 to the boss 15.

I claim:

1. A fan comprising two hub members; a flat plate member sandwiched between said hub members; at least two blades, each blade having a short stem at the root thereof with a boss on the end of the stem remote from the blade which boss is secured between said two hub members, each hub member being semi-circularly notched to fit around said stem and each boss being of circular cross-section transverse to the axis of the boss, said axis being a radial axis of the fan, each boss further including a diametral groove formed in the boss at the root end of each blade for partially straddling the periphery of said plate member, each boss being smoothly curved in its longitudinal section with its maximum diameter intermediate its ends, the side surface of the boss merging smoothly into the end surface nearer the blade, which end surface is a portion of a spherical surface whose radius of curvature is equal to the distance of that surface from the center point of said flat plate member; and means securing said two hub members and plate together with said hub members at least partially embracing said bosses and with their outer peripheries adjacent one another in a diametral plane in the regions between said blades whereby said blades are held onto said plate; said hub members being of the same uniform shape in all radial planes to conform to and fit around the side and top of each boss, the peripheral portions of said hub members being smoothly curved in a plane transverse to said radial planes and containing said center point so as closely to embrace the spherical end surface of the boss on each of said blades; and the radially outermost portions of said hub members extending inwardly towards one another over part of the end surfaces of the boss adjacent the root of the fan blade.

2. A fan as claimed in claim 1 wherein the hub members are formed of metal.

3. A fan as claimed in claim 1 wherein each boss has a central recess, said groove being formed in the periphery of the boss.

4. A fan as claimed in claim 1 and wherein the blades with their bosses are formed integrally of a resilient plastic material and wherein said groove in the boss is formed so as to resiliently grip said plate member.

* * * * *